US006782858B2

(12) United States Patent
Haas et al.

(10) Patent No.: US 6,782,858 B2
(45) Date of Patent: Aug. 31, 2004

(54) VALVE DRIVE FOR AN INTERNAL COMBUSTION ENGINE

(75) Inventors: Michael Haas, Weisendorf (DE); Henning Karbstein, Strullendorf (DE)

(73) Assignee: Ina-Schaeffler KG (DE)

( * ) Notice: Subject to any disclaimer, the term of this patent is extended or adjusted under 35 U.S.C. 154(b) by 0 days.

(21) Appl. No.: 10/395,364

(22) Filed: Mar. 21, 2003

(65) Prior Publication Data

US 2003/0177988 A1 Sep. 25, 2003

(30) Foreign Application Priority Data

Mar. 21, 2002 (DE) ..... 102 12 522

(51) Int. Cl.[7] ..... F01L 1/14

(52) U.S. Cl. ..... 123/90.5; 123/90.16; 123/90.55

(58) Field of Search ..... 123/90.48, 90.49, 123/90.5, 90.51, 90.52, 90.53, 90.54, 90.55, 90.56, 90.57, 90.58, 90.59, 90.15, 90.16, 90.17

(56) References Cited

U.S. PATENT DOCUMENTS

| | | | | |
|---|---|---|---|---|
| 3,108,508 A | | 10/1963 | Warden | 83/13 |
| 3,108,580 A | | 10/1963 | Crane, Jr. | 123/90 |
| 3,822,683 A | * | 7/1974 | Clouse | 123/90.5 |
| 4,406,257 A | * | 9/1983 | Keske et al. | 123/90.48 |
| 5,088,455 A | | 2/1992 | Moretz | 123/90.5 |
| 5,127,374 A | * | 7/1992 | Morel et al. | 123/90.35 |
| 5,178,107 A | * | 1/1993 | Morel et al. | 123/90.35 |
| 5,253,621 A | | 10/1993 | Dopson et al. | 123/90.16 |
| 5,263,386 A | * | 11/1993 | Campbell et al. | 74/569 |
| 5,307,769 A | * | 5/1994 | Meagher et al. | 123/90.5 |
| 5,431,133 A | | 7/1995 | Spath et al. | 123/90.16 |
| 5,501,187 A | * | 3/1996 | Speil et al. | 123/90.22 |
| 5,546,899 A | * | 8/1996 | Sperling et al. | 123/90.5 |

FOREIGN PATENT DOCUMENTS

DE 19712610 11/1997

* cited by examiner

*Primary Examiner*—Thomas Denion
*Assistant Examiner*—Jaime Corrigan
(74) *Attorney, Agent, or Firm*—Ostrolenk, Faber, Gerb & Soffen, LLP

(57) ABSTRACT

In a valve drive for an internal combustion engine, an elongated securing device or anti-rotation bridge referred to as a mounting aid has receptacle spaces, arranged at intervals one behind the other, for receiving respective valve tappets. Each valve tappet can be displaced longitudinally in its receptacle space. The tappet is secured against rotation by two parallel planar keying faces formed on its outer surface which bear against corresponding inner surfaces in a receptacle space of the mounting aid. The mounting aid has receptacle spaces with a relatively small interval dimension between the two inner surfaces for bearing against the keying faces of standard roller tappets and has receptacle spaces with a relatively large interval dimension between the two inner surfaces for bearing against the keying faces of switchable roller tappets.

6 Claims, 2 Drawing Sheets

VALVE DRIVE FOR AN INTERNAL COMBUSTION ENGINE

FIELD OF THE INVENTION

The invention relates to a valve drive for an internal combustion engine. The drive has an elongated securing device or anti-rotation bridge which is referred to as a mounting aid. The device or bridge has receptacle spaces, arranged at intervals one behind the other, for valve tappets. A valve tappet, which is embodied as a roller tappet is arranged in each receptacle space and is secured with a tappet roller directed at a cam of a camshaft and in such a way that the valve tappet can be displaced longitudinally in the receptacle space at right angles to the longitudinal axis of the camshaft. The valve tappet is secured against rotation by two parallel planar key faces, which are formed on its outer surface and which bear against corresponding inner surfaces of the mounting aid.

BACKGROUND OF THE INVENTION

In the United States, pushrod engines are still in widespread use as combustion engines. For any type of these engines there may be mounting aids for the roller tappets, embodied as either switchable tappets or as standard roller tappets. The respective roller tappets are pressed into a mounting aid and that aid is in turn mounted on the cylinder block. The present invention relates to a simple check as to whether the tappets are arranged in the correct position on the combustion engine.

In internal combustion engines it is known to use a plastic bridge to secure a roller tappet against rotation. The tappet is held in the plastic bridge by face-guiding means. Here, at least one planar face section is formed on the outer surface of the circular-cylindrical tappet, and it interacts with a corresponding planar surface section of a receptacle space of the mounting device. The mounting device may be a plastic part. In order to simplify transportation and mounting of the valve drive parts, the tappets are premounted on the mounting device with a pressure against the interfaces which are in mutual contact with one another.

A mounting device, in which the clamping of the tappets which is necessary for mounting is also effective during later operation of the engine when only the anti-rotation function is required, is disclosed in U.S. Pat. No. 5,088,455. That mounting aid or securing device is injection-molded from plastic with an appropriate glass-fiber reinforcement. However, the mounting aid or securing device is configured only for standard roller tappets, i.e. the positioning and the correct rotation of the tappets are of secondary importance.

As the fuel consumption and thus the emissions of pollutants of all engines also have to be reduced in the United States, future engines will be fitted with cylinder deactivation devices. Those respective cylinders which are to be deactivated are provided with switchable roller tappets which are different than normal tappets. In particular, in eight-cylinder engines, these switchable roller tappets are arranged irregularly with respect to the left-hand or right-hand banks of cylinders of a V8 engine in accordance with the ignition sequence.

Publication DE 197 12 610 A1 discloses a mounting device of an internal combustion engine of the type mentioned at the beginning and explains that combustion engines usually have roller valve tappets which engage with cam elevations of a camshaft. As the tappets cannot rotate about their longitudinal axis because the rollers have to remain on the tappets in the same plane as the cam elevations, the tappets are oriented in a suitable way in the cylinder block of the combustion engine with securing devices, and their rotation is prevented.

SUMMARY OF THE INVENTION

An object of the invention is to provide a securing device or mounting aid for the valve tappets of an internal combustion engine in which both standard roller tappets and switchable roller tappets can be mounted reliably at the correct points which are respectively assigned to them and the tappets having correct attitudes.

This object is achieved with the invention in that the mounting aid has both receptacle spaces with a first, e.g. relatively small, interval dimension of the two inner surfaces for bearing the keying faces of standard roller tappets and receptacle spaces with a second, e.g. relatively large, interval dimension of the two inner surfaces for bearing the keying faces of switchable roller tappets. The first and second dimensions may be reversed as to which is the larger, or other distinguishing profiling besides respective interval dimensioning may be selected.

A compression spring which surrounds the tappet and which is secured by means of a supporting plate and a Seeger ring may be arranged in the mounting aid in each receptacle space for a switchable roller tappet. The Seeger ring has a tongue which is integrally formed on its inner surface and which engages in a groove, corresponding in shape to the tongue, in the internal housing of the roller tappet.

Here, the Seeger ring may additionally have a tongue which is integrally formed on its outer surface and which engages in a cutout, corresponding to the shape of this tongue, in the mounting aid.

Other features and advantages of the present invention will become apparent from the following description of the invention which refers to the accompanying drawings.

BRIEF DESCRIPTION OF THE DRAWINGS

An exemplary embodiment of the invention is illustrated in the drawings and is described in more detail below.

DETAILED DESCRIPTION OF PREFERRED EMBODIMENT

Figure 2:
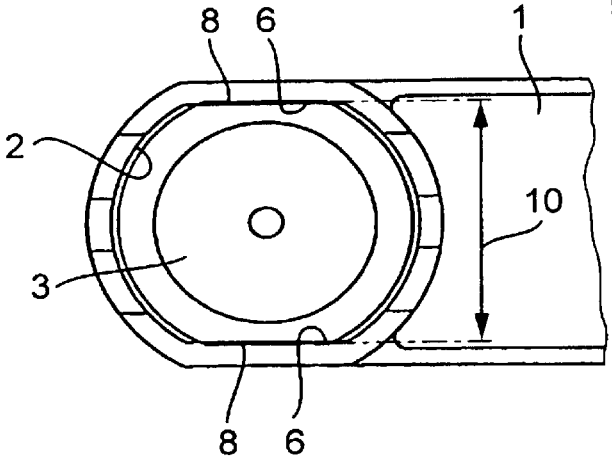
FIG. 2 shows an end region of the mounting aid with an inserted standard roller tappet in an end view.
Figure 3:
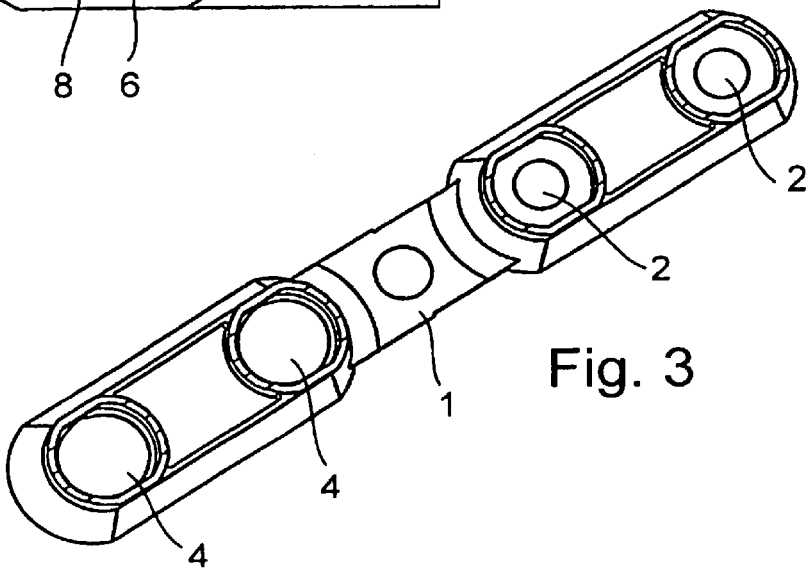
FIG. 3 shows a perspective view of the mounting aid.
Figure 4:
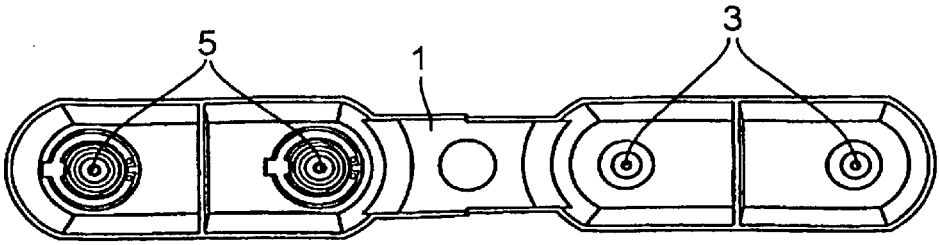
FIG. 4 shows an end plan view of the mounting aid.

A mounting aid 1 according to the invention which is illustrated in FIGS. 3 and 4 has along its length two receptacle spaces 2 for standard roller tappets 3 and two receptacle spaces 4 for switchable roller tappets 5. As is apparent from FIGS. 1 and 2, planar inner surfaces 6 and 7 of the mounting aid 1 are formed for the securing positions of the roller tappets in the respective receptacle spaces 3 and 4. The inner surfaces 6 interact in each case with keying faces 8 of the standard roller tappet 3 in a receptacle space 2, with the standard roller tappet 3 being located in the receptacle space 2. The inner surfaces 7 run in a receptacle space 4, in each case parallel to keying faces 9 of the switchable roller tappet 5 which is arranged in the receptacle space 4. The inner surfaces 6 and 7 therefore correspond to the respective keying faces 8 and 9 of the roller tappets 3 and 5 so that the mounting aid 1 can serve as an anti-rotation protection in the engine operating mode.

The keying faces 8 for the standard roller tappet 3 are on a smaller interval dimension than the keying faces 9 of the switchable roller tappet 5. In the standard roller tappet 3, a specific pressing dimension is ensured between the keying faces 8 and the inner surfaces 6 for mounting. As a result, the rollers of the roller tappet 3 continuously correspond to the cams provided for them on a camshaft.

Figure 1:
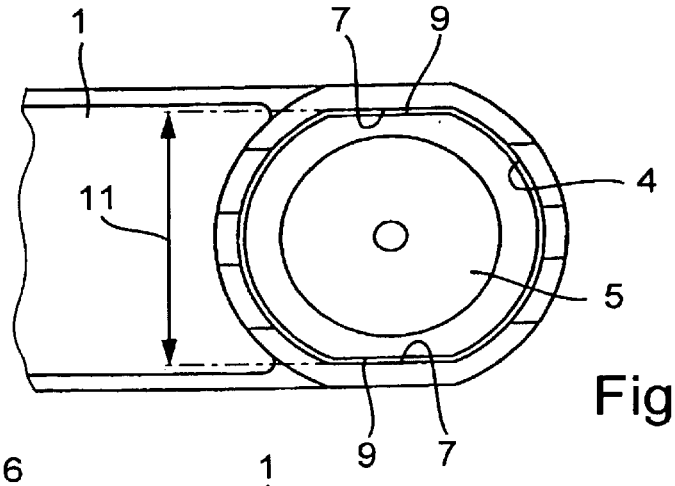
FIG. 1 shows an end region of a mounting aid with an inserted switchable roller tappet in an end view.

With reference to FIGS. 1 and 2, if a standard roller tappet 3 is moved into the wrong position, i.e. into the receptacle space 4, which is provided for a switchable roller tappet 5, in the mounting aid 1, the pressing dimension which is necessary to be able to mount the entire system composed of the tappet 3 and the mounting aid 1 is not provided. During the mounting process, the tappet 3 therefore drops out of the receptacle space 4. It thus becomes clear that tappet 3 was in the wrong position. If the standard roller tappet 3 is in the correct position illustrated in FIG. 2, in which position the pressing dimension fits, the tappet 3 is held in its position so that the mounting aid 1 can then be screwed into the engine block.

Conversely, owing to the relatively small distance between the inner surfaces 6 of the receptacle space 2, a switchable roller tappet 5 cannot be moved into the wrong position at all as there is too large an overlap between the key faces 9 with respect to the corresponding inner surfaces 6 as corresponding bearing faces in the mounting aid 1. Therefore, the switchable roller tappet 5 cannot be pressed into the receptacle space 2. The distance 10 between the inner surfaces 6 in the receptacle space 2 for standard roller tappets 3 is smaller than the distance 11 between the inner surfaces 7 in the receptacle space 4 for switchable roller tappets 5.

Despite the fact that the installation length is the same, i.e. the pushrods of the valves are of the same length, the overall length of the switchable roller tappet 5 is greater than that of the standard roller tappet 3. This makes it necessary, as shown in FIG. 3, to provide free spaces, i.e. the diameters of the drilled holes in the receptacle spaces 4 for the switchable roller tappets 5 must be expanded. They are larger than the diameters of the drilled holes in the receptacle spaces 2 for the standard roller tappets 3.

Figure 5:
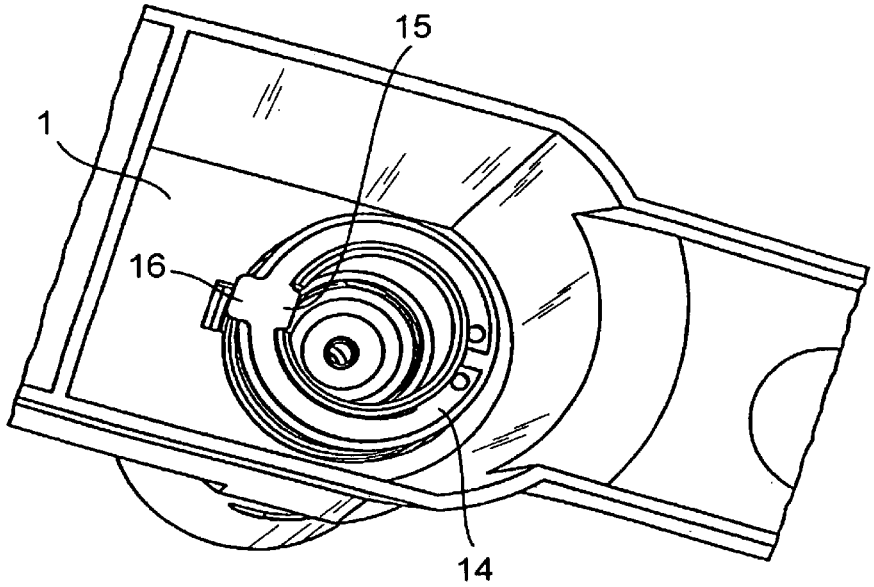
FIG. 5 shows a perspective view of a region of the mounting aid with an inserted switchable roller tappet.

FIG. 4 shows how a mounting aid 1 with mounted switchable roller tappets 5 and mounted standard roller tappets 3 may look in a view from above. It is necessary to ensure that each switchable roller tappet 5 is installed in the correct position, i.e. it is not turned in a mirror-inverted fashion under any circumstances, in order to ensure the corresponding supply of oil for the switching mechanism. For this purpose, a compression spring 12 (FIGS. 6 and 7) which is contained in the roller tappet and is what is referred to as a lost motion spring is secured by means of a supporting plate 13 and a Seeger ring 14. Referring to FIG. 5, this Seeger ring then has two features which distinguish it from a standard Seeger ring.

The Seeger ring is positioned correctly with respect to the switchable roller tappet 5 as follows. An inner tongue 15 which is integrally formed on the inner surface of the Seeger ring 14 engages in a groove formed on the internal housing of the roller tappet 5. As a result, the Seeger ring can only be mounted in the corresponding correct position. Otherwise, it cannot be moved into the groove provided for it. If the roller tappet 5 is mounted in the correct position, a further outer tongue 16 which is integrally formed on the outer surface of the Seeger ring 14 engages in a corresponding cutout in the mounting aid 1 in the position, and the roller tappet 5 can then be mounted with the correct attitude. If an attempt were to be made to install the roller tappet 5 in a position which is turned in a mirror-inverted fashion, that attempt would fail because the groove of the mounting aid 1 would then not be located in the region of the outer tongue 16 of the Seeger ring 14.

Figure 6:
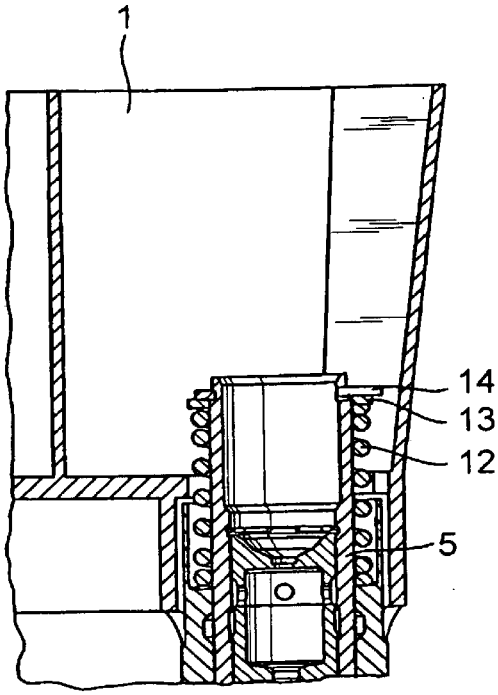
FIG. 6 shows a longitudinal view of the switchable roller tappet inserted in the mounting aid.
Figure 7:
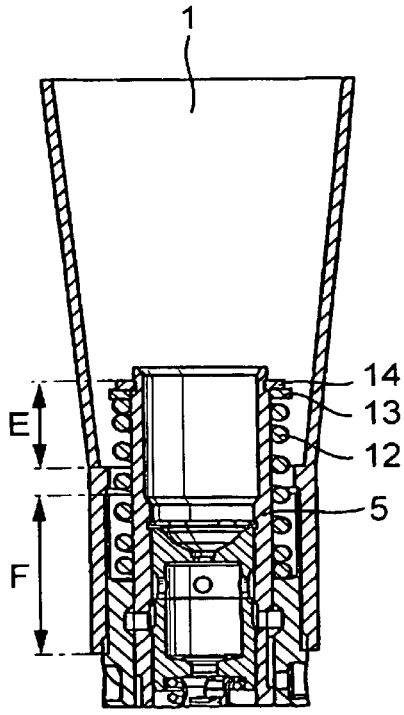
FIG. 7 shows a longitudinal section of the roller tappet which has been inserted in the mounting aid and rotated through 90° with respect to FIG. 6.

As is apparent from FIGS. 6 and 7, it is necessary to prevent the tappet from being able to be rotated through 180° during the insertion of the roller tappet 5 in the mounting aid 1. This can be avoided by suitably matching corresponding lengths, namely of the distance E of the Seeger ring 14 from the upper edge of the anti-rotation key faces 9 on the tappet 5 and the corresponding length of the corresponding bearing faces 7 in the mounting aid 1. For this purpose, E must be smaller than F.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An elongated securing device or anti-rotation bridge as a mounting aid for a valve drive for an internal combustion engine, the device or bridge having a plurality of first and second receptacle spaces with each space for receiving a valve tappet and the receptacle spaces being arranged at intervals one after the other;

a respective first valve tappet being located in each of the first receptacle spaces and a respective second valve tappet being located in each of the second receptacle spaces, wherein the valve tappets can be displaced longitudinally in their respective receptacle spaces;

each of the valve tappets being secured in its respective receptacle space against rotation of the valve tappet in the receptacle space with respect to the device, wherein each tappet has an outer surface including two parallel planar keying faces formed on the outer surface, and the receptacle space for the tappet has corresponding inner surfaces defining the receptacle space and shaped and positioned for bearing against the keying faces of the respective tappet;

wherein the first receptacle spaces have a relatively smaller interval dimension between the respective inner surfaces, and the keying faces of the first valve tappets have a corresponding interval dimension for receiving the first keying faces against the first inner surfaces of the first valve tappets and wherein the second receptacle spaces have a relatively larger interval dimension between the respective inner surfaces, and the keying faces of the second valve tappets have a corresponding interval dimension for receiving the second keying faces against the second inner surfaces of the second valve tappets.

2. The valve drive of claim 1, wherein the valve tappets are roller tappets and the valve tappets are longitudinally displaceable in their receptacle spaces at a right angle to the longitudinal axis of a camshaft.

3. The device or bridge of claim 1, wherein the first tappets with the keying faces at the first interval dimension are standard roller tappets and the second tappets with the second keying faces at the second interval dimension are switchable roller tappets.

4. The device or bridge of claim 3, further comprising a respective compression spring surrounding at least some of the switchable roller tappets; a supporting plate in the device or bridge for the spring and a Seeger ring arranged in the device or bridge in each receptacle space for the switchable roller tappets;

the Seeger ring having an inner surface and a tongue formed on the inner surface thereof, the respective switchable roller tappet at which the Seeger ring is located includes an internal housing and a groove in the internal housing, and the tongue of the Seeger ring engaging in the groove in the internal housing of the roller tappet.

5. The device or bridge of claim 4, wherein the Seeger ring includes an outer surface and an additional tongue formed on the outer surface of the Seeger ring;

a cut-out formed in the mounting aid and receiving the additional tongue.

6. An elongated securing device or anti-rotation bridge as a mounting aid for a valve drive for an internal combustion engine, the device or bridge having a plurality of first and second receptacle spaces with each space for receiving a valve tappet, and the receptacle spaces being arranged at intervals one after the other;

a respective first valve tappet being located in each of the first receptacle spaces and a respective second valve tappet being located in each of the second receptacle spaces, wherein the valve tappets can be displaced longitudinally in the respective receptacle spaces;

each of the valve tappets being secured in its respective receptacle space against rotation of the valve tappet in the receptacle space with respect to the device, comprising the first receptacle spaces having a first profile and the second receptacle spaces having a different second profile; the first tappets having the respective first profile to be shaped to enable the first tappets to be received in the first profile of the first receptacle spaces; the second tappets having the respective second profile to be shaped to be received in the second profile of the second receptacle spaces, wherein the first and second profiles are different such that upon attempting to insert a first tappet into a second receptacle space or a second tappet into a first receptacle space, the respective profiles of the tappets and the receptacle spaces are such that the tappet is either prevented by the profile of the receptacle space from being installed in the receptacle space or the tappet is not held securely in the receptacle space and may fall free of the receptacle space, whereby the first tappets are installable in a manner preventing rotation of the first tappet with respect to the device or bridge only in the first receptacle spaces and the second tappets are installable in a manner preventing rotation of the second tappet with respect to the device or bridge only in the second receptacle spaces.

* * * * *